US012049717B2

(12) United States Patent
Dilo et al.

(10) Patent No.: US 12,049,717 B2
(45) Date of Patent: Jul. 30, 2024

(54) NEEDLE BOARD AND METHOD FOR POPULATING A NEEDLE BOARD

(71) Applicant: Oskar Dilo Maschinenfabrik KG, Eberbach (DE)

(72) Inventors: Johann Philipp Dilo, Eberbach (DE); Jochen Lehr, Eberbach (DE); Rebekka Dilo, Eberbach (DE)

(73) Assignee: Oskar Dilo Maschinenfabrik KG, Eberbach (DE)

( * ) Notice: Subject to any disclaimer, the term of this patent is extended or adjusted under 35 U.S.C. 154(b) by 42 days.

(21) Appl. No.: 18/082,064

(22) Filed: Dec. 15, 2022

(65) Prior Publication Data

US 2023/0193538 A1 Jun. 22, 2023

(30) Foreign Application Priority Data

Dec. 22, 2021 (EP) ..... 21216867

(51) Int. Cl.
*D04H 18/02* (2012.01)
*D04H 1/46* (2012.01)

(52) U.S. Cl.
CPC ..... *D04H 18/02* (2013.01); *D04H 1/46* (2013.01)

(58) Field of Classification Search
CPC ..... D04H 18/02; D04H 18/00; D04H 1/46; D04H 3/102; D04H 3/105; D04H 5/02; D04H 13/005
USPC ..... 28/107–115
See application file for complete search history.

(56) References Cited

U.S. PATENT DOCUMENTS 3,530,557 A * 9/1970 Dilo ..... D04H 18/02 28/112
3,606,654 A * 9/1971 Dilo ..... D04H 18/00 28/115
4,038,728 A * 8/1977 Fehrer ..... D04H 18/02 28/110
4,384,393 A * 5/1983 Asselin ..... D04H 18/02 28/107
4,884,324 A * 12/1989 Stanislaw ..... D04H 18/02 28/107
5,148,584 A * 9/1992 Fehrer ..... D04H 18/02 28/115
6,003,215 A 12/1999 St. Jacques
6,145,176 A 11/2000 Egnaczak
(Continued)

FOREIGN PATENT DOCUMENTS

CN 107059253 A * 8/2017 ..... D04H 18/02
CN 108085875 A * 5/2018 ..... D04H 18/02
(Continued)

OTHER PUBLICATIONS

EP 21 21 6867 Search Report dated Jun. 21, 2022.

*Primary Examiner* — Amy Vanatta
(74) *Attorney, Agent, or Firm* — Jansson Munger McKinley & Kirby Ltd.

(57) ABSTRACT

A needle board for fastening to a needle beam of a needle loom, which serves for consolidating a fibrous pile web, comprises a carrier plate having a receiving apparatus in which a plurality of needle modules are received which are arranged in a row. The needle board further comprises a fluid-activatable clamping device which is configured to fix the plurality of needle modules in the receiving apparatus at least in a first direction.

16 Claims, 5 Drawing Sheets

(56) References Cited

U.S. PATENT DOCUMENTS

| | | | | |
|---|---|---|---|---|
| 6,735,836 | B2 * | 5/2004 | Jourde | D04H 18/00 28/115 |
| 9,260,806 | B2 * | 2/2016 | Dilo | D04H 1/46 |
| 2010/0162543 | A1 * | 7/2010 | Dilo | D04H 18/00 28/115 |
| 2016/0069006 | A1 * | 3/2016 | Dilo | D04H 18/02 28/115 |
| 2017/0130380 | A1 * | 5/2017 | Dilo | D04H 18/00 |
| 2021/0324558 | A1 * | 10/2021 | Dilo | D04H 18/02 |

FOREIGN PATENT DOCUMENTS

| | | | | |
|---|---|---|---|---|
| DE | 102005034144 | B3 * | 12/2006 | D04H 18/02 |
| EP | 1 391 546 | A1 | 2/2004 | |
| EP | 3 000 923 | A1 | 3/2016 | |
| EP | 3 896 207 | A1 | 10/2021 | |

* cited by examiner

NEEDLE BOARD AND METHOD FOR POPULATING A NEEDLE BOARD

FIELD OF THE INVENTION

The present invention relates to a needle board and to a method for populating such a needle board which is suitable for fastening to a needle beam of a needle loom, the latter serving for consolidating a fibrous pile web.

BACKGROUND OF THE INVENTION

In a needle loom, a fibrous pile web is usually fed at an inlet and in the needle loom is conveyed in a conveying direction of the fibrous pile web to a needle zone. At least one needle beam having a needle board fastened thereto is arranged in the region of the needle zone, said needle board being populated with needles for consolidating the fibrous pile web. The needles compact the fibrous pile web in that said needles are driven so as to penetrate the fibrous pile web in a penetration direction and to be extracted from the latter again at a high frequency. The product created is a consolidated non-woven fabric. Known to the person skilled in the art are the most varied forms of needle looms, including also double-needle looms in which the needling takes place from above and from below by two needle beams, or needle looms in which the needle beam during the consolidation procedure is moved conjointly with the fibrous pile web in the conveying direction of the fibrous pile web.

There are attempts aimed at increasing the density of the needles of a needle board and thus of the needling of the fibrous pile web so as to optimize the properties of the consolidated non-woven fabric. However, this increase in terms of the density of the needles is restricted owing to production and assembly tolerances in terms of the dimensions and the positions of the needles, the needle boards, of the down-holding and stitch plates and the resultant increased risk of a collision between the needles and the down-holding and stitch plates. The needles may break during a collision, which in many applications represents an unacceptable risk.

SUMMARY OF THE INVENTION

It is an object of the present invention to provide a needle board for a needle loom as well as a method for populating such a needle board, said needle board and said method enabling an increase in terms of the needle density.

According to an aspect of the invention, a needle board for fastening to a needle beam of a needle loom, which serves for consolidating a fibrous pile web, has a carrier plate having a receiving apparatus in which are received a plurality of needle modules arranged in a row, wherein each needle module of the plurality of needle modules has a plurality of needles. Furthermore, the needle board has a fluid-activatable clamping device which is configured to fix the plurality of needle modules in the receiving apparatus at least in a first direction.

In this way, the plurality of needle modules in the receiving apparatus can be moved, freely positioned and aligned before the needle modules are fixed in terms of the position thereof. Dimensional variances that arise can already be taken into account when aligning the needle modules. Moreover, needle modules having a small number of needle rows can be precisely manufactured and thus be positioned in an ideally individual manner. Despite a high density of the needles on the needle board, any collision with further components of the needle loom, such as down-holding and stitch plates, for example, can be reliably avoided. The fluid-activatable clamping device is particularly suitable for fixing the plurality of needle modules because said fluid-activatable clamping device is of a simple configuration and is readily activatable and readily able to be integrated in the needle board.

The needle modules of the plurality of needle modules in the receiving apparatus are preferably arranged one behind another in a row in a second direction. The second direction is preferably perpendicular to the first direction. Each needle module preferably has a module carrier and a plurality of needles which are received in the module carrier and are preferably fixedly connected to the module carrier. For example, the module carrier is formed from plastics material, and the plurality of needles are cast or insert-molded in the module carrier, respectively.

The plurality of needles of each needle module are preferably arranged in at least one row, wherein the at least one row of needles preferably extends in a third direction which is perpendicular to the first and to the second direction. The needles of a row in this instance are arranged one behind another in the third direction. Each needle module of the plurality of needle modules can have, for example, between one row and five rows of needles, preferably between one row and three rows of needles, more preferably exactly one row of needles. As a result, the needle rows can be ideally aligned in a mutually independent manner, in particular in terms of the down-holding and stitch plates, and the needle modules are easy to produce. Not all needle modules have to have the same number of rows of needles.

The first direction, the second direction and the third direction preferably define a Cartesian coordinate system. In one preferred embodiment, the first direction is substantially vertical, and the second and the third direction are substantially horizontal. The second direction here preferably extends parallel to a longitudinal direction of the needle board, said longitudinal direction being parallel to a working width of the needle loom, and the third direction preferably extends parallel to a conveying direction of the fibrous pile web.

The needle board can also have a plurality of receiving apparatus, wherein the receiving apparatus are preferably arranged behind one another in the third direction. In this instance, a plurality of needle modules arranged in a row are received in each receiving apparatus of the plurality of receiving apparatuses. Therefore, all features and advantages which have been described in the context of the receiving apparatus can thus be applied in an analogous manner to a plurality of receiving apparatuses, which is why a dedicated description is dispensed with.

The clamping device is preferably a pneumatically activatable clamping device. For example, the clamping device can be activated by compressed air, as a result of which a particularly simple and cost-effective implementation is made possible. The use of other gases is however likewise conceivable, as is the embodiment of the clamping device as a hydraulically activatable clamping device which is activated by hydraulic fluid.

In one preferred embodiment, the clamping device is configured to effect a holding force at least in the first direction on the plurality of needle modules and/or the receiving apparatus. The holding force fixes the needle modules at least in the first direction and can act directly on the needle modules and/or the receiving apparatus. The clamping device particularly preferably fixes in a form-fitting manner the plurality of needle modules in the first direction, and in a force-fitting manner in the second and/or the third direction, in the receiving apparatus.

In order for the plurality of needle modules to be introduced into the receiving apparatus and for the needle modules to be displaced or aligned, respectively, in the second direction in the receiving apparatus, a certain clearance between the needle modules, in particular the module carriers, and the receiving apparatus is advantageous. As a result of the holding force being applied by the clamping device, the plurality of needle modules in this instance is fixed at least in the first direction, for example by way of a form-fit between a part of the receiving apparatus and a component part of the needle board, or of the carrier plate, respectively. Furthermore, the holding force can suffice to effect a force-fit or friction-fit, respectively, between the needle modules and the receiving apparatus such that said needle modules are also fixed in the second and the third direction.

The clamping device can be adjustable between an activated state and a non-activated state. In the non-activated state of the clamping device, the plurality of needle modules are preferably displaceable in order for the needle modules to be introduced and retrieved, and in the activated state of the clamping device said plurality of needle modules are fixed in the receiving apparatus.

In one embodiment, the clamping device comprises at least one clamping element which has a first state in which the plurality of needle modules are movable in the receiving apparatus, and a second state in which the at least one clamping element is expanded in comparison to the first state and fixes the plurality of needle modules in the receiving apparatus. The first state of the clamping element may correspond to the non-activated state of the clamping device, and the second state of the clamping element may correspond to the activated state of the clamping device. In this way, the clamping device is configured as simply as possible and without any complex mechanism. In the second state, the at least one clamping element effects the holding force.

The clamping device can be activated in that the at least one clamping element in the first state is vented, and in the second state is impinged with pressure. The impingement of the at least one clamping element with pressure can take place by a supply of fluid, in particular by compressed air. Therefore, the at least one clamping element is preferably connectable to a fluid source, for example a pump. To this end, the at least one clamping element can have at least one connector and/or one valve.

The at least one clamping element is preferably configured to autonomously maintain the second state. This can be achieved in that the at least one clamping element has a check valve which enables the supply of fluid into the clamping element and prevents any autonomous discharge of fluid from the clamping element. In this way, no permanent fluid supply is required, as a result of which the needle board can be flexibly used and does not need to be connected to a fluid supply, in particular during the operation of the needle loom.

A particularly simple configuration of the at least one clamping element is made possible when the at least one clamping element is configured as a hose, in particular as a compressed air hose. The hose in a simple manner forms a fluid line for distributing the fluid in the needle board in order for the clamping device to be activated, can be easily installed in the needle board, and in the second state provides a uniform distribution of pressure to the plurality of needle modules or to the receiving apparatus, so as to act as the clamping element of the clamping device.

In order for the at least one clamping element to be able to act uniformly on the plurality of needle modules or the receiving apparatus, said at least one clamping element preferably extends parallel to the second direction. The at least one clamping element can extend along the entire receiving apparatus in the second direction. However, it is also conceivable for a plurality of clamping elements to be arranged behind one another in the second direction.

A space-saving construction and an ideally direct action of force can be achieved in that the at least one clamping element is received in the receiving apparatus. In the case of a plurality of receiving apparatuses, at least one clamping element is preferably received in each receiving apparatus. A uniform transmission of force and an avoidance of jamming between needle modules and the receiving apparatus can be achieved when two clamping elements, for example two hoses, are received in the receiving apparatus. The two clamping elements in this instance are preferably arranged so as to be symmetrical in terms of the plurality of needle modules, for example so as to be symmetrical to a central or symmetry plane of the needle modules, said plane being defined so as to be parallel to the first and to the second direction.

In one preferred exemplary embodiment the receiving apparatus is mounted so as to be movable in the first direction relative to the carrier plate and by the clamping device can be moved between a releasing position and a clamping position. The stroke length of the receiving apparatus between the releasing position and the clamping position can be 1 to 5 mm, preferably 1 to 2 mm.

The receiving apparatus is in the releasing position when the at least one clamping element is in the first state. The receiving apparatus is in the clamping position when the at least one clamping element is in the second state. In the releasing position, there can be adequate clearance between the plurality of needle modules and the receiving apparatus in order for the needle modules to be displaced in the receiving apparatus. The receiving apparatus can be moved to the clamping position by activating the clamping device, in particular by transferring the at least one clamping element to the second state, as a result of which the clearance between the plurality of needle modules and the receiving apparatus is initially reduced and finally eliminated. In this instance, the plurality of needle modules are fixed in a form-fitting manner in the first direction.

For example, the needle board can have a bearing element which is fixedly connected to the carrier plate and is at least partially received in the receiving apparatus. The bearing element on a side that faces away from the carrier plate has a bearing face on which an upper side of the plurality of needle modules can bear. On a lower side of the needle modules, which lies opposite the upper side of the needle modules, the needles protrude from the respective module carrier. In this case, the plurality of needle modules are received in the first direction between the bearing element and the receiving apparatus.

The bearing element can have at least one rebate which extends so as to be parallel to the second direction. The at least one rebate can form a cavity in the bearing element, or between the bearing element and the carrier plate, and serve for receiving the at least one clamping element. The bearing element preferably has two rebates which are aligned in a mutually opposite manner and run parallel to the second direction. The rebates, in terms of the third direction, are arranged on a front side and a rear side of the bearing element.

In one preferred embodiment, a first portion of the receiving apparatus extends into the cavity formed by the at least one rebate. The at least one clamping element is received between the at least one rebate and the first portion of the receiving apparatus. When the at least one clamping element is transferred to the second state, said clamping element moves the first portion, and thus the receiving apparatus, in the direction of the carrier plate. As a result, the plurality of needle modules are pressed against the bearing element.

The receiving apparatus preferably comprises a first and a second receiving element being mutually opposite in the first direction and therebetween receiving the clamping device and the plurality of needle modules, wherein the needles of the plurality of needle modules extend out of the receiving apparatus, preferably between the first and the second receiving element. A longitudinal direction of the first and of the second receiving element is preferably parallel to the second direction, and the first and the second receiving element form a guide for the needle modules, said guide running parallel to the second direction. In this way, the receiving apparatus is of an ideally simple configuration, while the needle modules are reliably received and at the same time are displaceable parallel to the second direction. The first and the second receiving element in the second direction preferably extend across the entire width of the receiving apparatus. However, it is also conceivable for a plurality of first and/or second receiving elements to be arranged behind one another in the second direction. For example, the first and the second receiving element can be formed from a sheet metal, in particular a steel sheet.

The first and the second receiving element are configured to support the plurality of needle modules. The first and the second receptacle modules conjointly can form the guide for displacing the plurality of needle modules parallel to the second direction. To this end, each of the two receiving elements comprises in particular a support portion on which bears a peripheral region of the module carriers of the plurality of needle modules. More specifically, each module carrier comprises a first peripheral region and a second peripheral region, opposite the first peripheral region, wherein the at least one needle row of the respective needle module extends from the first to the second peripheral region. The first peripheral region in this instance can bear on the support portion of the first receiving element, and the second peripheral region can bear on the support portion of the second receiving element.

In one preferred embodiment, the first and the second receiving element are in each case configured so as to be substantially C-shaped. The first and the second receiving element in this case have in each case three legs, wherein a first leg extends parallel to the carrier plate, a second leg on an end of the first leg extends perpendicularly to the carrier plate, and a third leg, on an end of the second leg that lies opposite the first leg, extends parallel to the carrier plate. The third leg of the first and of the second receiving element preferably forms the support portion of the respective receiving element. The first leg of the first receiving element and the first leg of the second receiving element conjointly can form the first portion of the receiving apparatus that is arranged in the cavity formed by the at least one rebate of the bearing element. The at least one clamping element in this instance is arranged between the first leg of the first and/or the second receiving element and the bearing element.

The clamping device can act directly on the plurality of needle modules or, in particular when the receiving apparatus is mounted so as to be movable relative to the carrier plate, can act on the receiving apparatus.

The needle board in all embodiments can furthermore comprise a fluid-activatable releasing apparatus which, in a direction counter to the holding force, is configured to effect a counterforce so as to release the plurality of needle modules in the receiving apparatus. It may be that the at least one clamping element (for example in the form of a hose) cannot be transferred back to the first state in a simple manner, for example owing to incomplete or delayed venting, the elasticity of the material of the at least one clamping element and/or pre-tensioning of the latter. This is counteracted by the counterforce in order to be able to insert or retrieve the plurality of needle modules in an ideally simple manner.

In one embodiment, in which the clamping device acts on the receiving apparatus and the receiving apparatus is mounted so as to be movable relative to the carrier plate, the releasing apparatus preferably transmits the counterforce to the receiving apparatus.

In order to make possible a simple and cost-effective construction, the releasing apparatus preferably comprises at least one pressure element. The at least one pressure element can be configured in a manner that is analogous to that of the at least one clamping element, for example in terms of the embodiment or the construction of the latter, respectively, the activation and the number of pressure elements, so that the features described with reference to said clamping element can be applied in an analogous manner to the at least one pressure element. The number of pressure elements preferably corresponds to the number of clamping elements, and each clamping element is assigned one pressure element in order to counteract said clamping element. Therefore, two pressure elements are preferably also provided for each receiving apparatus, said pressure elements being arranged so as to be symmetrical in relation to the receiving apparatus, or to the plurality of needle modules, respectively.

The at least one pressure element can also have a first state and a second state, wherein the at least one pressure element in the second state is expanded in comparison to the first state. Particularly suitable to this end is the configuration of the at least one pressure element as a hose, in particular as a compressed air hose. In the first state, the at least one pressure element effects substantially no counterforce, while said pressure element in the second state effects the counterforce and releases the plurality of needle modules in the receiving apparatus.

In one preferred embodiment, the needle board comprises a plurality of layers arranged on top of one another, wherein the carrier plate forms a first layer of the plurality of layers. The plurality of layers is preferably arranged on top of one another in the first direction.

The plurality of layers can moreover comprise a further plate which forms a second layer of the plurality of layers, wherein the further plate and the carrier plate are arranged so as to be mutually spaced apart. The further plate is preferably arranged above the carrier plate in the first direction. The carrier plate and the further plate in the first direction can have a thickness which is between 5 and 10 mm, preferably between 6 and 8 mm.

The at least one pressure element is preferably arranged outside the receiving apparatus. The at least one pressure element in this embodiment can be received between two layers of the plurality of layers of the needle board, for example between the carrier plate and the further plate. In this case, the further plate acts as a counter bearing for the at least one pressure element such that the counterforce effected by the latter on the receiving apparatus is exerted in a targeted manner in the first direction.

Despite the multi-layered construction of the needle board, the weight and the dimensions of the latter are to be kept as low as possible. Therefore, it is preferable for the carrier plate and/or the further plate to be formed from a fibre-reinforced material.

In order for the carrier plate and the further plate to be arranged at a defined mutual spacing, it is preferable for the plurality of layers to furthermore comprise a third layer which is formed by at least one spacing element. The at least one spacing element is arranged in the first direction between the carrier plate and the further plate. A plurality of spacing elements, each extending parallel to the second direction and being mutually spaced apart in the third direction, are preferably provided. In this way, an intermediate space is in each case configured between two adjacent spacing elements of the plurality of spacing elements, said intermediate space toward the top being delimited by the further plate and a pressure element being able to be received in the former.

The at least one spacing element can be configured as, for example, a strip or a flat profile, preferably from aluminium. The at least one spacing element in the first direction can have a thickness which is between 3 and 8 mm, preferably between 5 and 6 mm.

Instead of a plurality of spacing elements, it is also conceivable for the at least one spacing element to be configured so as to be substantially plate-shaped and to comprise at least one recess in order to form a cavity for receiving the at least one pressure element.

One pressure element is preferably arranged in each case in the first direction above a clamping element. In general, the releasing apparatus can comprise at least one transmission element, wherein the at least one pressure element transmits the counterforce by the at least one transmission element, preferably onto the receiving apparatus. The at least one transmission element can be configured, for example, as a pin or bolt. Each pressure element is preferably assigned a plurality of transmission elements, wherein the transmission elements that are assigned to the same pressure element are arranged behind one another in the second direction. The carrier plate can comprise a plurality of through openings, the number of the latter corresponding to the number of transmission elements and the transmission elements being received in said through openings.

The at least one transmission element preferably extends from at least one pressure element, through a through opening in the carrier plate, to the receiving apparatus, in particular to the first portion of the receiving apparatus, or to the first leg of the first or the second receiving element, respectively. In this way, the releasing apparatus can exert the counterforce on an upper side of the first portion of the receiving apparatus, while the clamping device can exert the holding force on the lower side of the first portion of the receiving apparatus.

During operation, a penetration direction of the plurality of needle modules into the pile to be consolidated is substantially parallel to the first direction. Therefore, accelerations act on the plurality of needle modules substantially parallel to the first direction. The plurality of needle modules in the first direction are fixed by the clamping device, in particular in a form-fitting manner between the first and the second receiving element and the carrier plate or the bearing element. The needle modules of the plurality of needle modules are fundamentally displaceable relative to one another in the second direction, and the holding force may be sufficient for fixing the plurality of needle modules in a force-fitting manner in the second direction. The plurality of needle modules can be correspondingly fixed in a force-fitting manner also in the third direction.

However, in many applications it is also desirable for the needle board to be moved conjointly with the fibrous pile web in the conveying direction while said needle board is engaged with said fibrous pile web. In the process, the needle board during the oscillating movement is also imparted a movement component which is parallel to the third direction. In this case it is possible that the acceleration forces overcome the holding force of the needle modules, or that the receiving apparatus, in particular the first and the second receiving element, is/are deformed.

Therefore, the needle board in all embodiments of the present invention can have a bracing apparatus which is configured to effect on the receiving apparatus an interlocking force at least in the third direction. The interlocking force in turn can serve for fixing in a form-fitting manner the plurality of needle modules in the third direction in the receiving apparatus. Additionally or alternatively, the interlocking force can fix in a force-fitting manner the plurality of modules. As a result of the bracing apparatus it can, therefore, be ensured that the plurality of needle modules in the receiving apparatus are fixed in the third direction even in the event of accelerations.

The interlocking force can be conceived in such a manner that said interlocking force deforms the receiving apparatus, in particular the first and/or the second receiving element, in the direction of the module carriers of the plurality of needle modules and, as a result, fixes said plurality of needle modules in the third direction, preferably in a form-fitting manner between the first and the second receiving element.

The bracing apparatus can comprise at least one bracing element which, proceeding from a foot portion, is configured so as to taper in the direction of the carrier plate. The at least one bracing element can be configured in the form of a strip, for example, which extends parallel to the second direction.

The foot portion of the at least one bracing element in the first direction is preferably arranged so as to be below the third leg of the first and/or second receiving element and comprises a bearing region for the third leg. The at least one bracing element, proceeding from the foot portion, runs at least partially along the second leg of the respective receiving element. The position of the at least one bracing element relative to the carrier plate may be adjustable, for example by a screw connection between the bracing element and the needle board.

The at least one bracing element is initially spaced apart from the carrier plate, said spacing enabling the receiving apparatus to be arranged in the releasing position. When the receiving apparatus is then transferred to the clamping position, the at least one bracing element can be moved parallel to the first direction, in the direction of the carrier plate. Owing to the tapered configuration of the at least one bracing element, the first and/or the second receiving element is increasingly deformed in the third direction, toward the plurality of needle modules. The interlocking force acts substantially on the second leg of the first or the second receiving element, respectively.

If a plurality of receiving apparatuses are provided, one bracing element is in each case preferably arranged between two adjacent receiving apparatus. Each bracing element in this instance can engage with the second receiving element of receiving apparatus, below the first receiving element of the adjacent receiving apparatus, and mutually brace said receiving elements.

As an alternative to each bracing element, a fluid-activatable clamping apparatus can also be used within or outside the respective receiving apparatus, said fluid-activatable clamping apparatus being constructed in a manner analogous to that of the previously described clamping elements, running in the first and the second direction, and exerting a clamping force on the needle modules in the third direction.

According to another aspect of the invention, a needle loom for needling a non-woven fabric web comprises a needle beam assembly which comprises a needle beam and at least one needle board fastened to the needle beam, wherein the needle board has a structure as described above. Provided in this way is a needle loom which is suitable for very high needle densities without posing an increased risk in terms of needles colliding with down-holding or stitch plates of the needle loom.

The needle loom preferably has a first main shaft on which a first main con rod is eccentrically mounted, said first main con rod connecting in an articulated manner the first main shaft to the needle beam assembly. As a result, an oscillating movement of the needle beam assembly in the penetration direction can be implemented, wherein the penetration direction is preferably parallel to the first direction.

In order to achieve a substantially elliptic movement path of the needle beam assembly, the needle loom can furthermore have a second main shaft on which a second main con rod is eccentrically mounted, said second main con rod connecting in an articulated manner the second main shaft to the needle beam assembly. The first main shaft and the second main shaft preferably rotate in opposite directions.

The fibrous pile web to be consolidated is moved through the needle loom in a conveying direction which is substantially parallel to the third direction. The fibrous pile web in the region of the needle beam assembly is preferably received between a down-holding plate and a stitch plate of the needle loom, said plates being arranged above or below the fibrous pile web, respectively, and having openings for the needles of the plurality of needle modules to enter or pass through.

In the case of high needle densities, the down-holding plate in particular can be configured as a wire plate which comprises a plurality of stationary wires that run parallel to the conveying direction. The wires are arranged so as to be mutually spaced apart in the second direction. During the operation of the needle loom, in each case one needle row of the plurality of needle modules preferably passes through between two adjacent wires and enters the fibrous pile web. Accordingly, it is necessary for the needle modules in the second direction to be positioned in such a manner that the needle rows are arranged between the wires in order to avoid collisions.

The at least one needle board is preferably releasably connected to the needle beam so that the needle loom can be equipped with different needle boards, or that the at least one needle board can be populated with the plurality of needle modules in a simple manner outside the needle loom.

In one preferred embodiment, the needle loom comprises a further fluid-activatable clamping device which is configured to fasten the at least one needle board to the needle beam. This enables simple and reliable assembling of the needle board.

For improved differentiation, the clamping device of the needle board for fixing the plurality of needle modules in the receiving apparatus herein is also referred to as the first clamping device, and the clamping device of the needle loom for fastening the needle board to the needle beam is also referred to as the second clamping device.

The second clamping device can likewise be a pneumatically activatable clamping device and comprise at least a second clamping element, preferably in the form of a hose, which is adjustable between a first and a second state. Therefore, the features of the first clamping device can substantially be applied in an analogous manner to the second clamping device. The at least one second clamping element runs in particular so as to be parallel to the second direction.

In one preferred embodiment, the needle beam comprises a front shoulder and a rear shoulder. The front shoulder in the conveying direction is directed towards the front. The rear shoulder in the conveying direction is directed towards the rear. A second clamping element of the second clamping device is in each case arranged on an upper side of the front portion and of the rear portion that faces away from the needle board.

Furthermore provided is in each case one clamping angle, more specifically a front clamping angle and a rear clamping angle. The front clamping angle and the rear clamping angle preferably comprise in each case a first leg which is arranged so as to be substantially parallel to the needle board and above the respective second clamping element, a second leg which from the first leg beside the needle beam extends downwards, and a third leg which extends parallel to the first leg in the direction of the needle board and engages with the needle board. Consequently, the at least one second clamping element is received between the front and/or the rear shoulder of the needle beam and the first leg of the front and/or the rear clamping angle.

If the needle board comprises a plurality of layers, a rebate in which the third leg engages is preferably configured between two layers of the plurality of layers. For example, this rebate is configured between the carrier plate and the further plate of the needle board. This can be achieved in that the at least one spacing element in the third direction has a smaller width than the further plate.

When the clamping elements of the second clamping device are in the first state, the needle board can be released from the needle beam or be attached to the latter. When the clamping elements of the second clamping device are in the second state, the needle board by the clamping angles is pulled upwards and pressed against the needle beam, and is fixed on the latter.

According to another aspect of the invention, a method for populating a needle board, which is provided for fastening to a needle beam of a needle loom, comprises the following steps:

- inserting a plurality of needle modules into a receiving apparatus which is attached to a carrier plate of the needle board, wherein needles of the plurality of needle modules extend in a first direction, and the needle modules of the plurality of needle modules in the receiving apparatus are arranged behind one another and movable relative to one another in a second direction which is perpendicular to the first direction;
- generating a relative movement between the needle board and an adjustment installation, wherein the adjustment installation comprises a plurality of adjustment elements which are arranged so as to be mutually parallel and extend in a third direction which is perpendicular to the first and to the second direction;
- aligning the plurality of needles on the plurality of adjustment elements by way of the relative movement between the needle board and the adjustment installation;

fixing the plurality of needle modules in the receiving apparatus after the alignment, by a fluid-activatable clamping device.

In this way, the needle modules already produced can be precisely aligned while taking into consideration dimensional variances, so as to avoid collisions during the operation, as has already been described at the outset in the context of the needle board.

The method particularly preferably serves for populating a needle board having a structure as described above. Therefore, all features and advantages that have been described with reference to the needle board can be applied in an analogous manner to the method, and vice versa.

The populating of the needle board can take place outside the needle loom, in the adjustment installation, wherein the needle board and the needle modules are particularly readily accessible. The plurality of adjustment elements in this instance are preferably configured so as to correspond to the down-holding plate, in particular designed as a wire plate. The plurality of adjustment elements in this case can be formed by a plurality of wires. However, it is also conceivable for the needle board to be populated in the needle loom, wherein the down-holding plate can form the adjustment installation.

The plurality of needle modules are inserted into the receiving apparatus and in the latter are initially movable in the second direction. The relative movement preferably takes place parallel to the longitudinal direction of the needles, or the penetration direction of the latter, respectively, which may correspond to the first direction. In the relative movement between the needle board and the adjustment installation, the needles of incorrectly aligned needle modules can contact the respective adjacent adjustment element. Because the plurality of adjustment elements are arranged so as to be stationary, the respective needle module during the relative movement is then displaced in the second direction so far until said adjustment elements and said needle module during a next stroke in the penetration direction would no longer impact one another. In this instance, each row of needles is preferably arranged between two adjacent adjustment elements. The plurality of needle modules are now correctly aligned and can be fixed. It is also possible for the relative movement to have a component in the second and/or the third direction. For example, the needles of the plurality of needle modules can initially be arranged between the adjustment elements, and the needle board or the adjustment installation can subsequently be agitated so as to effect a distribution and alignment of the plurality of needle modules.

The step of fixing the plurality of needle modules preferably comprises the following steps:

generating a holding force in the first direction on the plurality of needle modules and/or the receiving apparatus by the clamping device; and fixing in a form-fitting manner the plurality of needle modules in the first direction, and fixing in a force-fitting manner the plurality of needle modules in the second direction, and preferably the third direction, by way of the holding force.

If the populating of the needle board takes place outside the needle loom, the needle board, after populating with the plurality of needle modules and after fixing the plurality of needle modules, can be inserted into the needle loom. The needle board in the needle loom is preferably fastened to the needle beam by the second clamping device.

Since the plurality of clamping elements of the first clamping device preferably autonomously maintain the second state, said plurality of clamping elements, after fixing the plurality of needle modules, can be disconnected from a suitable fluid supply such that the needle board in the populated state is able to be handled without impediment.

If the needle board comprises a bracing apparatus as described above, the method, after the fixing of the plurality of needle modules by the first clamping device, can furthermore comprise the activating of the bracing apparatus so as to interlock in a form-fitting manner the plurality of needle modules also in the third direction. The activating of the bracing apparatus preferably comprises the moving of the at least one bracing element in the direction of the carrier plate, as a result of which at least one receiving element of the receiving apparatus is deformed.

DETAILED DESCRIPTION OF SPECIFIC EMBODIMENTS

Figure 1:
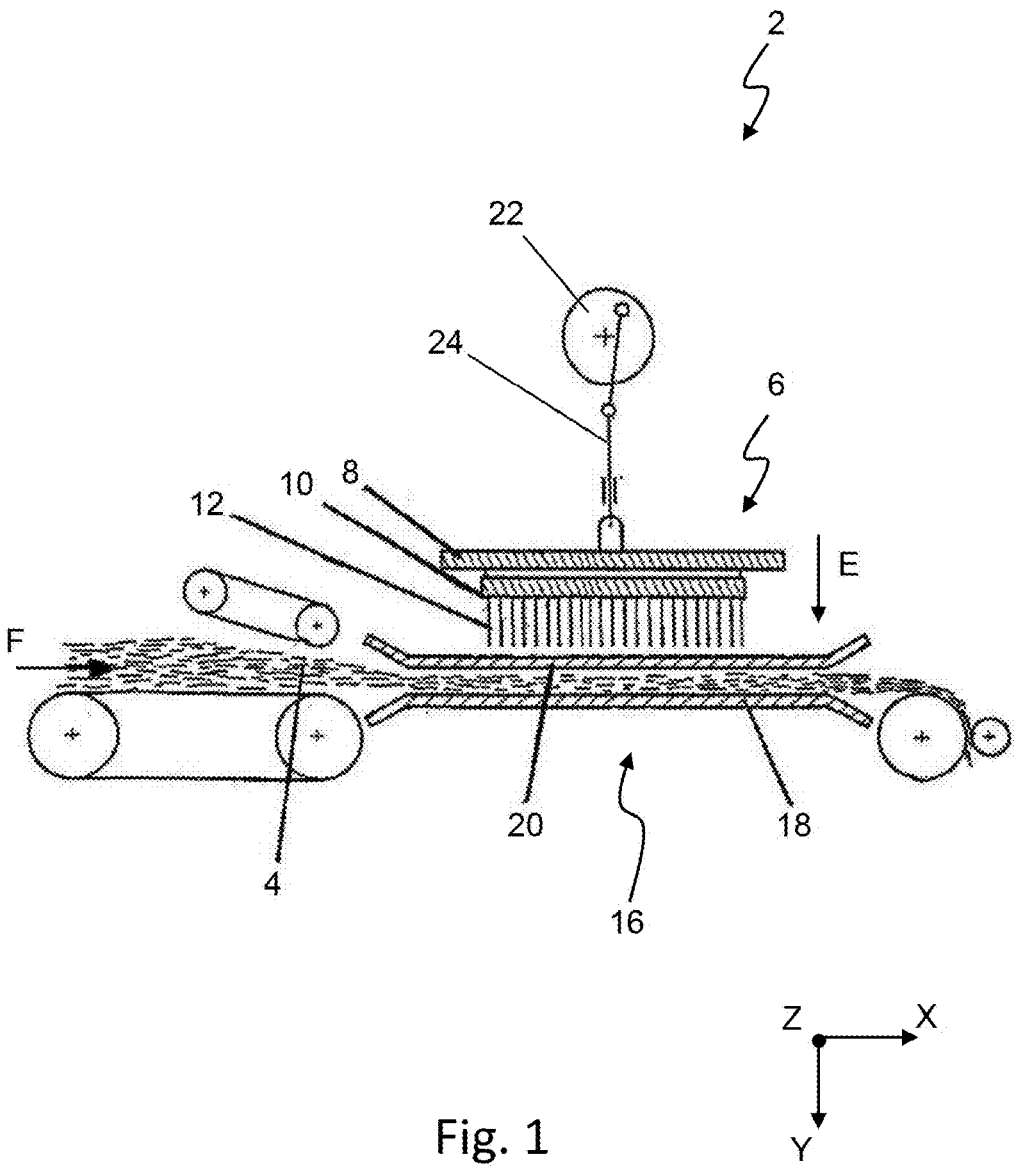
FIG. 1 shows a schematic view of a needle loom.

The fundamental construction of a needle loom 2 is schematically illustrated in FIG. 1. The needle loom 2 serves for consolidating a fibrous pile web 4 which is fed to the needle loom 2 in a conveying direction F and which passes through the needle loom 2 in the conveying direction F. The needle loom 2 comprises a needle beam assembly 6 having a needle beam 8 and at least one needle board 10 which is releasably fastened to the needle beam 8. The needle board 10 has a multiplicity of needles 12 which are a component part of a plurality of needle models 14 that are illustrated in detail in FIGS. 2 to 5.

In order for the fibrous pile web 4 to be consolidated, the needles 12 are moved in an oscillating manner up and down in a penetration direction E, and in the process invade the fibrous pile web 4. The penetration direction E is preferably substantially perpendicular to the conveying direction F.

In order to be able to invade the fibrous pile web 4 as deeply as possible, or to optionally penetrate the latter, the needle loom 2 in a needle zone 16, in which the needle beam assembly 6 is also arranged, can have a stitch plate 18. The stitch plate 18 facilitates the fibrous pile web 4 in the needle zone 16 and has openings into which the tips of the needles 12 can enter should the latter penetrate the fibrous pile web 4. In order to extract as few fibres as possible, if any, from the fibrous pile web 4 when extracting the needles 12 from the fibrous pile web 4, the needle loom 2 in the needle zone 16 furthermore comprises a down-holding plate 20. The down-holding plate 20 is arranged above the fibrous pile web 4 and retains the fibrous pile web 4, and particularly the fibres thereof, when extracting the needles 12. The down-holding plate 20 has openings through which the needles 12 can pass.

As it is difficult in the case of high needle densities, owing to the very minor spacing of the needles 12, to provide a corresponding number of openings and align the latter precisely with the needles, the stitch plate 18 and the down-holding plate 20 can be configured as wire plates. Each wire plate comprises a plurality of stationary wires which are aligned so as to be parallel to the conveying direction F. The wires of the plurality of wires are arranged so as to be mutually spaced apart in a direction perpendicular to the conveying direction F and to the penetration direction E, so as to enable the needles 12 to pass through. For example, a row of needles 12, which is arranged so as to be parallel to the third direction, can in each case pass through between two adjacent wires.

The needle loom 2 furthermore has a first main shaft 22 on which a first main con rod 24 is eccentrically mounted. The first main con rod 24 connects in an articulated manner the first main shaft 22 to the needle beam assembly 6. Moreover, in many applications the needle loom 2 comprises a second main shaft and a second main con rod, the two latter being configured in a manner analogous to the first main shaft 22 and the first main con rod 24.

Furthermore illustrated in FIG. 1 is a Cartesian coordinate system which has a first direction Y, a second direction Z and a third direction X. The first direction Y is preferably substantially vertical, and the second direction Z and the third direction X are substantially horizontal. The conveying direction F is preferably parallel to the third direction X, and the penetration direction E is preferably parallel to the first direction Y.

Figure 2:
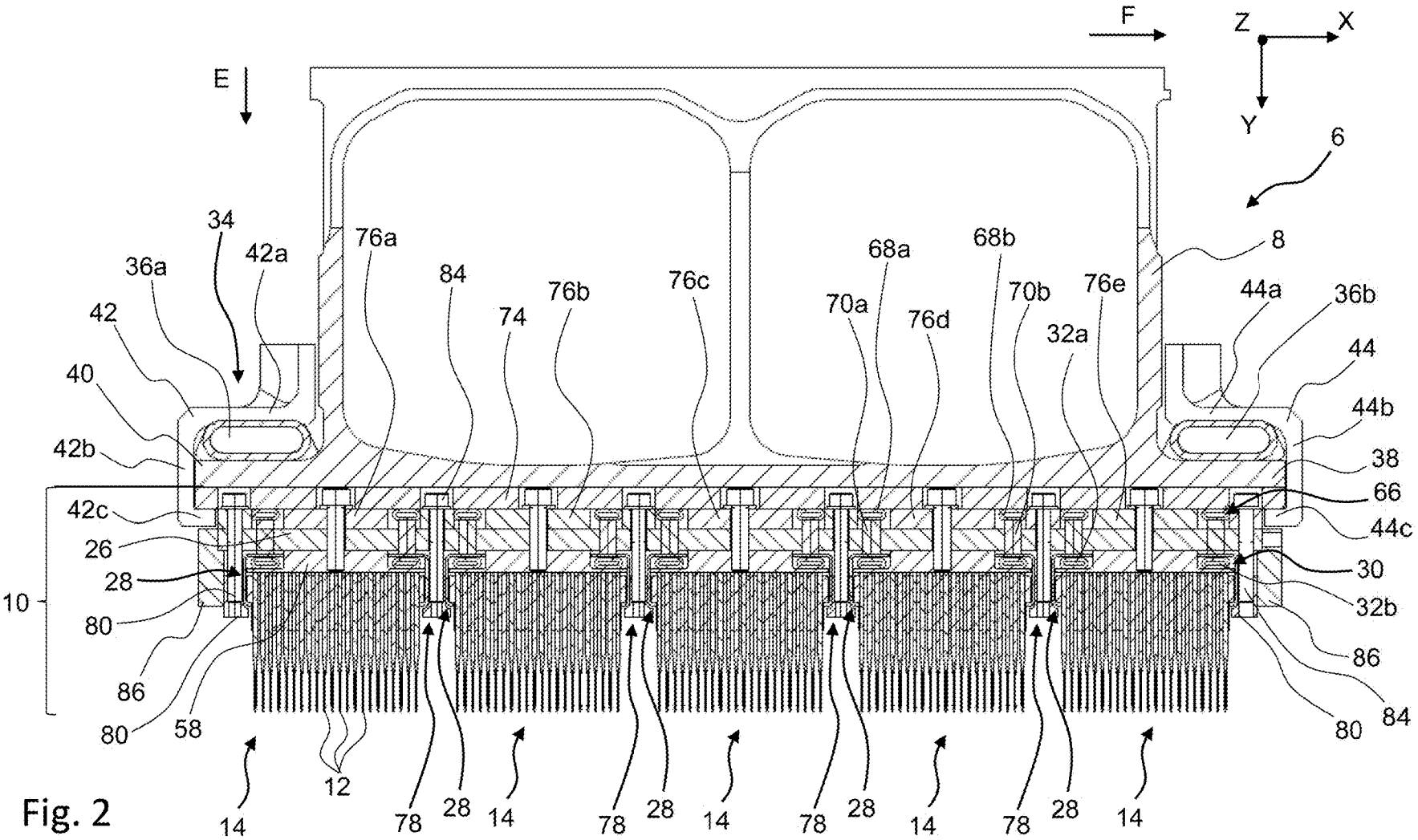
FIG. 2 shows a cross-sectional view of a needle beam assembly having a needle board according to an embodiment of the invention.

Illustrated in more detail in a cross-sectional view in FIG. 2 is the needle beam assembly 6 having the needle beam 8 and the needle board 10, wherein the section plane is defined by the first direction Y and the third direction X. The needle board 10 comprises a carrier plate 26 having at least one receiving apparatus 28 in which a plurality of needle modules 14 are received. Provided in the embodiment illustrated are five receiving apparatuses 28 which are arranged beside one another in the third direction X, each of said five receiving apparatuses 28 receiving a plurality of needle modules 14. The receiving apparatus 28 are constructed in an analogous manner, which is why only one receiving apparatus 28 will be described in more detail, the features of the latter being applicable in analogous manner to an arbitrary number of receiving apparatuses 28.

The needle board 10 furthermore comprises a fluid-activatable clamping device 30 which is also referred to as the first clamping device 30 and preferably has at least one first clamping element 32, here two first clamping elements 32*a*, 32*b*. The first clamping device 30 and the functional mode thereof will be described in more detail with reference to FIGS. 3 and 4.

The needle beam assembly 6 can comprise a second fluid-activatable clamping device 34 which can have at least one second clamping element 36 and here has two second clamping elements 36*a*, 36*b*. The second clamping device 34 is provided for fastening the needle board 10 to the needle beam 8. To this end, the needle beam 8 can have a front shoulder 38 and a rear shoulder 40, said shoulders 38, 40 from the needle beam 8 protruding towards the front or towards the rear, respectively, in terms of the conveying direction F. A second clamping element 36*a*, 36*b* is in each case arranged on the shoulders 38, 40, and extends parallel to the second direction Z.

The second clamping device 34 in this exemplary embodiment moreover comprises a rear first clamping angle 42 and a front second clamping angle 44. The first and the second clamping angle 42, 44, clamp the needle board 10 to the needle beam 8. To this end, each of the two clamping angles 42, 44 has a first leg 42*a*, 44*a* which extends so as to be substantially horizontal and above the respective shoulder 38, 40, a second leg 42*b*, 44*b* which beside the respective shoulder 38, 40 extends from the first leg 42*a*, 44*a* in a substantially vertical downward manner, and a third leg 42*c*, 44*c* which from the second leg 42*b*, 44*b* extends so as to be substantially horizontal in the direction of the needle board 10. The third leg 42*c*, 44*c* engages with the needle board 10 in that said third leg 42*c*, 44*c* extends into a rebate 46 which is configured on the needle board 10 and is also referred to as the needle board rebate, for example.

The second clamping elements 36*a*, 36*b* are preferably adjustable between a first and a second state, wherein said second clamping elements 36*a*, 36*b* in the second state are expanded in comparison to the first state. If the second clamping device 34 is configured as a pneumatically activatable clamping device 34, the second clamping elements 36*a*, 36*b* can be configured as hoses, in particular as pneumatically activatable pressure hoses. When the second clamping elements 36*a*, 36*b* are in the first state, the first and the second clamping angle 42, 44 are lowered, and the needle board 10 can be pushed in or retrieved parallel to the second direction Z. When the second clamping elements 36*a*, 36*b* are in the expanded second state, the first and the second clamping angle 42, 44 are lifted parallel to the first direction Y by the clamping elements, and the needle board 10 is pressed against the needle beam 8 as a result. In this way, the needle board 10 is fixedly attached to the needle beam 8.

Further details of the needle board 10 will be described hereunder with reference to FIG. 2 to FIG. 4.

The plurality of needle modules 14 in the receiving apparatus 28 are arranged behind one another in the second direction Z. Each needle module 14 has a module carrier 48 in which the needles 12 of the needle module 14 are received. Each needle module 14 preferably has only one row of needles 12, wherein the needles 12 are arranged behind one another in a row in the third direction X. The plurality of needle modules 14 are received in the receiving apparatus 28 in such a manner that a longitudinal direction of the needles 12 extends parallel to the penetration direction E.

The receiving apparatus 28 is configured in such a manner that the needle modules 14 of the plurality of needle modules 14 can be inserted, or pushed, respectively, into the receiving apparatus 28, in the receiving apparatus 28 can be displaced parallel to the second direction Z, and are held by the receiving apparatus 28. The receiving apparatus 28 can comprise a first receiving element 50 and a second receiving element 52, the longitudinal direction of said receiving elements 50, 52 preferably extending parallel to the second direction Z. The first and the second receiving element 50, 52 are mutually opposite in the third direction, and therebetween receive the plurality of needle modules 14, wherein the needles 12 between the first and the second receiving element 50, 52 extend out of the receiving apparatus 28.

In order to support the plurality of needle modules 14, each receiving element 50, 52 comprises a support portion 54, 56 on which bears in each case a peripheral region 48*a*, 48*b* of the module carriers 48. The first peripheral region 48*a* and the second peripheral region 48*b* of each module carrier 48 are mutually opposite, and the at least one needle row of the respective needle module 14 extends between the first and the second peripheral region 48*a*, 48*b*.

As illustrated, the first and the second receiving element 50, 52 can be configured so as to be substantially C-shaped. The first and the second receiving element 50, 52 accordingly have in each case one first leg 50*a*, 52*a*, a second leg

50*b*, 52*b*, and a third leg 50*c*, 52*c*. The first leg 50*a*, 52*a* and the third leg 50*c*, 52*c* are arranged so as to be mutually parallel, and the second leg 50*b*, 52*b* extends so as to be substantially perpendicular to the first leg and to the third leg, so as to be between the two latter. The third leg 50*c*, 52*c* of the first and of the second receiving element 50, 52, respectively, can form the respective support portion 54, 56 on which bear the module carriers 48.

The needle board 10 can furthermore comprise a bearing element 58 which is fixedly connected, for example screwed, to the carrier plate 26. The bearing element 58, on a side thereof that faces away from the carrier plate 26, has a bearing face 60 on which an upper side of the plurality of needle modules 14 can bear.

In order for the plurality of needle modules 14 to be fixed in the receiving apparatus 28, the receiving apparatus 28 can be mounted so as to be movable in the first direction Y relative to the carrier plate 26. For example, the bearing element 58 has two rebates 62, 64 which are aligned in a mutually opposite manner and run parallel to the second direction, specifically a rear rebate 62 and a front rebate 64. The rebates 62, 64 form a cavity between the bearing element 58 and the carrier plate 26, a first portion of the receiving apparatus 28 being able to extend into said cavity. The first portion of the receiving apparatus 28 is formed by the first leg 50*a*, 52*a* of the first and of the second receiving element 50, 52, for example. In this way, the first portion of the receiving apparatus 28 can move up and down between the bearing element 58 and the carrier plate 26, and is at the same time interlocked on the carrier plate 26 in terms of the first direction Y.

The first clamping device 30 is configured to fix the plurality of needle modules 14 at least in the first direction Y in the receiving apparatus 28, in particular in that said first clamping device 30 effects a holding force in the first direction Y on the plurality of needle modules 14 and/or the receiving apparatus 28. As a result, the first clamping device 30 fixes in a form-fitting manner the plurality of needle modules 14 in the first direction Y, and in a force-fitting manner in the second and the third direction.

The first clamping device 30 is preferably adjustable between an activated state and a non-activated state. To this end, the first and the second clamping element 32*a*, 32*b* can have a first state in which the plurality of needle modules 14 are movable in the receiving apparatus 28, and have a second state in which the first and the second clamping element 32*a*, 32*b* are expanded in comparison to the first state and fix the plurality of needle modules 14 in the receiving apparatus 28. The first and the second clamping element 32*a*, 32*b* preferably extend parallel to the second direction Z.

The first clamping device 30 is preferably configured as a pneumatically activatable clamping device, wherein the first and the second clamping element 32*a*, 32*b* are in each case formed by a hose. The clamping device 30 is activated by a supply of air, wherein the first and the second clamping element 32*a*, 32*b* are transferred from the first state to the second state.

The first and the second clamping element 32*a*, 32*b* are preferably received in the receiving apparatus 28. The clamping elements 32*a*, 32*b* in the embodiment illustrated are received in the cavity between the bearing element 58 and the carrier plate 26 that is formed by the rebates 62, 64. More specifically, the first clamping element 32*a* is arranged on the rear rebate 62 of the bearing element 58 and received between the bearing element 58 and the first leg 50*a* of the first receiving element 50. The second clamping element 32*b* is arranged on the front rebate 64 of the bearing element 58 and received between the bearing element 58 and the first leg 52*a* of the second bearing element 52.

When the first and the second clamping element 32*a*, 32*b* are transferred to the second state, said clamping elements 32*a*, 32*b* move the first legs 50*a*, 52*a* of the bearing elements 50, 52 upwards, parallel to the first direction Y, because the rebates 62, 64 of the bearing element 58 are stationary.

Figure 3:
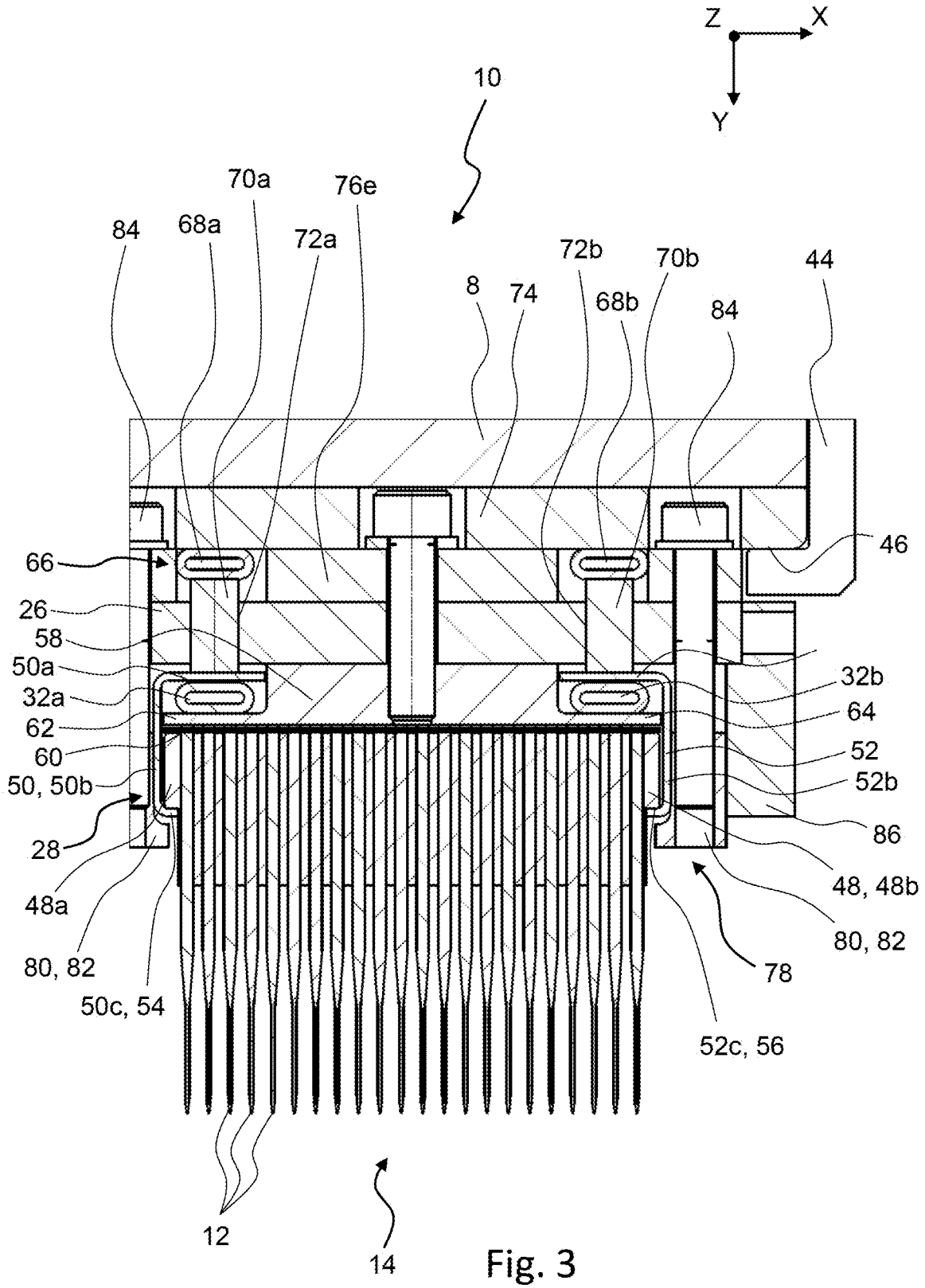
FIG. 3 in an enlarged view shows a fragment of the cross-sectional view as per FIG. 2.
Figure 4:
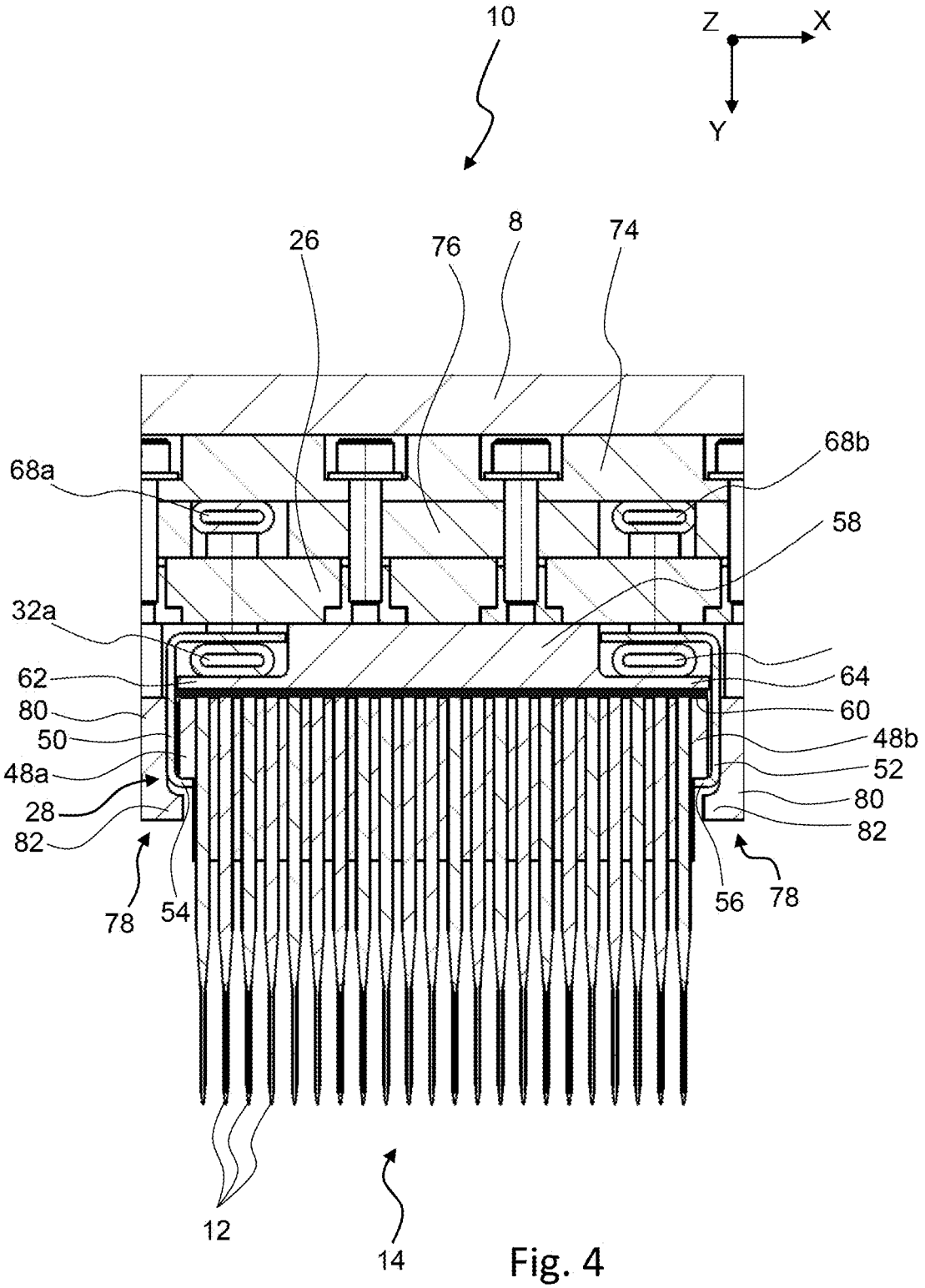
FIG. 4 in an enlarged view shows a fragment of the needle beam assembly as per FIG. 2 in a cross-sectional view in another section plane.

The clamping elements 32*a*, 32*b* are illustrated in the second state in FIGS. 3 and 4. The first and the second clamping element 32*a*, 32*b* in this state effect the holding force on the first and the second receiving element 50, 52 of the receiving apparatus. The plurality of needle modules 14 are pushed upwards and pressed against the bearing element 58 by the receiving elements 50, 52. The plurality of needle modules 14 are then received in a form-fitting manner between the bearing face 60 of the bearing element 58 and the support portions 54, 56 of the receiving elements 50, 52. The friction between the plurality of needle modules 14 and the bearing element 58 and the receiving elements 50, 52 may moreover suffice for fixing in a force-fitting manner the plurality of needle modules 14 in the second and the third direction Z, X.

In order for the first and the second clamping element 32*a*, 32*b* to be reset to the first state, said clamping elements 32*a*, 32*b* can be vented. The needle board 10 can additionally comprise a fluid-activatable releasing apparatus 66 which, in a direction counter to the holding force, effects a counter-force by way of which the plurality of needle modules 14 in the receiving apparatus 28 are released. This can be required, for example, in order to sufficiently vent or compress the clamping elements 32*a*, 32*b*.

In particular when the first clamping device 30 acts on the receiving apparatus 28, the releasing apparatus 66 can also act on the receiving apparatus 28. In the embodiment illustrated, the releasing apparatus 66 acts on the first and the second receiving element 50, 52 in order for the two latter to be moved back downwards, counter to the movement effected by the first clamping device 30. To this end, the releasing apparatus 66 preferably comprises at least one pressure element 68, here a first pressure element 68*a* and a second pressure element 68*b*. The first and the second pressure element 68*a*, 68*b* can be configured in a manner analogous to the clamping elements 32*a*, 32*b*. This means that the pressure elements 68*a*, 68*b* are preferably formed by pneumatically activatable hoses and extend parallel to the second direction Z.

The first and the second pressure element 68*a*, 68*b* have a first state and a second state, wherein the pressure elements 68*a*, 68*b* in the second state are expanded in comparison to the first state. The first and the second pressure element 68*a*, 68*b* in the second state effect the counterforce. The pressure elements 68*a*, 68*b* preferably autonomously maintain the second state.

The number of pressure elements 68*a*, 68*b* preferably corresponds to the number of clamping elements 32*a*, 32*b* such that each pressure element 68 is assigned to one clamping element 32 and can counteract the latter. The releasing apparatus 66 can comprise at least one transmission element 70, wherein each pressure element 68*a*, 68*b* is assigned at least one transmission element 70*a*, 70*b* by way of which said pressure element 68*a*, 68*b* acts on the receiving apparatus 28. The at least one transmission element 70 can be configured as a strip which runs parallel to the second direction Z, or be configured as a pin, as here. In this case, a plurality of transmission elements 70 are preferably provided for each pressure element 68, wherein the transmission elements 70 are arranged behind one another in the second direction Z.

The carrier plate 26 comprises a plurality of through openings 72*a*, 72*b*, the number of the latter corresponding to the number of transmission elements 70 and the transmission elements 70 being received in said through openings 72*a*, 72*b*. Each transmission element 70*a*, 70*b* extends from the pressure element 68*a*, 68*b* assigned thereto, through one of the through openings 72*a*, 72*b*, to the receiving apparatus 28, in particular to the first portion of the receiving apparatus 28, the latter here being formed by the first legs 50*a*, 52*a* of the first and the second receiving element 50, 52.

When the first and the second pressure element 68*a*, 68*b* are transferred to the second state, said pressure elements 68*a*, 68*b* effect the downward-directed counterforce on the transmission elements 70*a*, 70*b*, because said pressure elements 68*a*, 68*b* are upwardly supported in the needle board 10. The counterforce by way of the transmission elements 70*a*, 70*b* is transmitted to the first and the second receiving element 50, 52, the latter as a result being moved downwards to the extent that the counterforce is greater than the holding force, or the clamping elements 36*a*, 36*b* are vented. The form-fit between the needle modules 14 and the receiving apparatus 28 is released, and the needle modules 14 can be displaced and retrieved.

Receiving one or a plurality of releasing apparatus 66 in the needle board 10 can be particularly advantageously implemented in that the needle board 10 has a plurality of layers arranged on top of one another. The carrier plate 26 forms a first layer of the plurality of layers, and a further plate 74 forms a second layer of the plurality of layers. The carrier plate 26 and the further plate 74 are arranged at a mutual spacing, and the pressure elements 68 of the at least one releasing apparatus 66 are arranged between the carrier plate 26 and the further plate 74. The further plate 74 in the needle beam assembly 6 preferably bears on the needle beam 8, for example by way of an upper side that faces away from the carrier plate 26.

The plurality of layers can furthermore comprise a third layer which is formed by at least one spacing element 76 which is arranged between the carrier plate 26 and the further plate 74 in order for said carrier plate 26 and said plate 74 to be positioned at a defined spacing. As can be seen in FIG. 4, the plurality of layers are preferably fixedly connected, for example screwed, to one another.

The layers of the plurality of layers of the needle board 10 are preferably sized in such a manner that said layers form the needle board rebate 46 in which the first and the second clamping angle 42, 44 of the second clamping device 34 engage. To this end, the further plate 74 on both sides protrudes beyond the at least one spacing element 76 in the third direction X, for example.

Exactly one substantially plate-shaped spacing element 76, which has corresponding recesses for receiving the pressure elements 68 of the releasing apparatus 66, can be provided. The needle plate 10 in the embodiment illustrated comprises a plurality of spacing elements 76*a*, 76*b*, 76*c*, 76*d*, 76*e* which are configured in a mutually separate manner and of which the longitudinal direction extends parallel to the second direction Z, and which are arranged so as to be mutually spaced apart in the third direction X. Each pressure element 68 of the at least one releasing apparatus 66 can in this way be received in an intermediate space between two adjacent spacing elements 76.

Additional interlocking of the plurality of needle modules 14 in the third direction X in the receiving apparatus 28 can be achieved by at least one bracing apparatus 78 which is configured to effect an interlocking force at least in the third direction X on the receiving apparatus 28. As a result, the plurality of needle modules 14 can be fixed in a form-fitting manner in the third direction X. The bracing apparatus 78 deforms in particular the first and/or the second receiving element 50, 52 in such a manner that the plurality of needle modules 14 are fixed in a form-fitting manner in the third direction X.

The bracing apparatus 78 comprises at least one bracing element 80 which is assigned to one of the first and the second receiving element 50, 52. One bracing element 80 is preferably assigned to each receiving element 50, 52 of the receiving apparatus 28 or of the plurality of receiving apparatus 28. If a plurality of receiving apparatus 28 are provided beside one another, as is illustrated in FIG. 2, one bracing element 80 can in each case be arranged between two adjacent receiving apparatus 28 and thus be assigned to the first receiving element 50 of the one receiving apparatus 28 and to the second receiving element 52 of the adjacent receiving apparatus 28.

The at least one bracing element 80 has a foot portion 82 which in the first direction Y is preferably arranged below the respective receiving element 50, 52. For example, the foot portion 82 can form a contact region for the third leg 50*c*, 52*c* of the first or the second receiving element 50, 52, respectively. Proceeding from the foot portion 82, the at least one bracing element 80 extends upwards along the second leg 50*b*, 52*b* of the respective receiving element 50, 52. The at least one bracing element 80, proceeding from the foot portion 82, is particularly preferably configured so as to taper in the direction of the carrier plate 26. The at least one bracing element 80 in the form of a strip can extend parallel to the second direction Z, or a plurality of bracing elements 80 can be arranged behind one another in the second direction Z.

In order to effect the interlocking force on the receiving apparatus 28, the position of the at least one bracing element 80 relative to the carrier plate 26 is preferably adjustable. To this end, the bracing element 80 can be screwed to the needle board 10, as illustrated. The screw connection 84, from an upper side of the plurality of layers, here formed by the upper side of the further plate 74, preferably extends through the plurality of layers into the at least one bracing element 80. As a result, the position of the at least one bracing element 80 can be adjusted at any time before the needle board 10 is fastened to the needle beam 8, because the screw connection is accessible from the upper side. When the screw connection 84 is tightened, the bracing element 80 moves towards the carrier plate 26, while the bracing element 80 is moved away from the carrier plate 26 by releasing the screw connection 84.

As is illustrated in FIGS. 3 and 4, the receiving apparatus 28 is in a clamping position in which the plurality of needle modules 14 are fixed in the receiving apparatus 28. When the at least one bracing element 80 is now moved in the direction of the carrier plate 26, the taper of the bracing element 80 effects in particular an increasing interlocking force on the receiving elements 50, 52 in the third direction X and a deformation of the latter until bearing on the module carriers 48 of the needle modules 14.

As a result of this measure, the correct positioning of the plurality of needle modules 14 can be ensured even in the event of horizontal accelerations in the conveying direction F. Moreover, detents 86 which are preferably formed from carbon fibre-reinforced material can be provided on the peripheries of the needle board 10 that in the third direction X are arranged at the front or the rear, respectively. The detents 86 extend parallel to the second direction along the needle board 10 and can be screwed to the carrier plate 26, for example. The detents 86 in the third direction X support the support element 80 that is the frontmost or the rearmost in the third direction X, respectively, so as to suppress any deformation of said support element 80 in the case of acceleration in the third direction X.

One example of a method according to the invention will be described with further reference to FIG. 5, said method being based on the needle board 10 according to FIGS. 2 to 4. In order for the needle board 10 to be populated with needle modules 14, the plurality of needle modules 14 are first inserted into the at least one receiving apparatus 28 where the needle modules 14 are arranged behind one another in the second direction Z and are movable relative to one another. To this end, the receiving apparatus 28 is preferably in the releasing position, and the first clamping device 30 is in the non-activated state. If present, the pressure elements 68 of the releasing apparatus 66 can be in the second state thereof.

Figure 5:
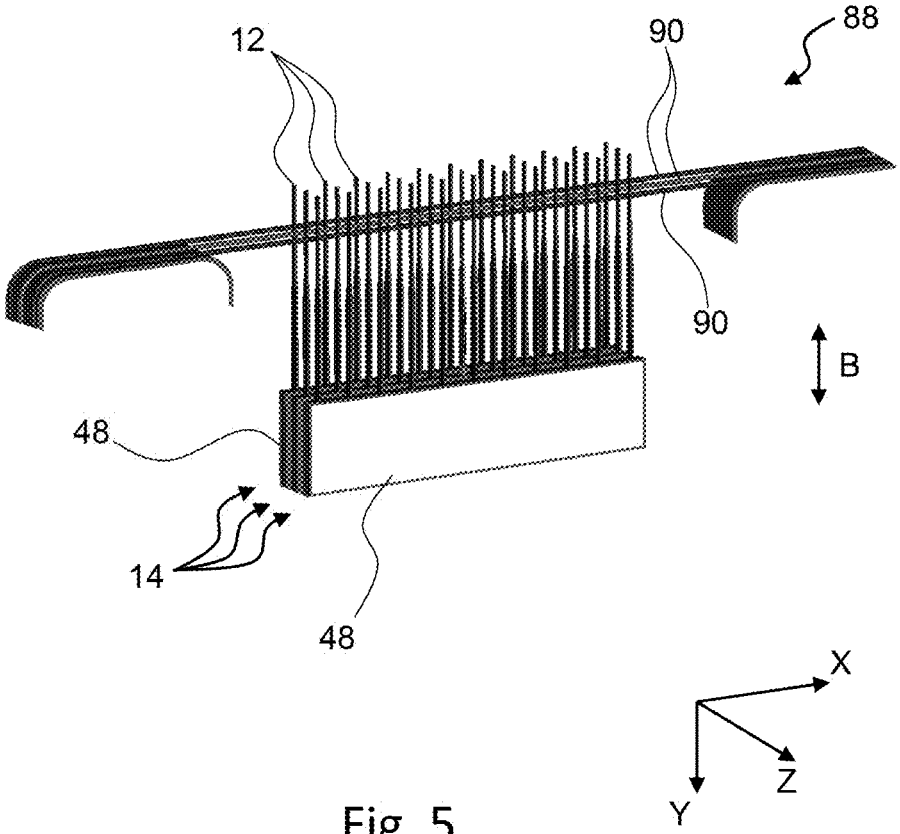
FIG. 5 schematically shows an adjustment installation for aligning a plurality of needle modules of the needle board.

A relative movement between the needle board 10 and an adjustment installation 88, which is schematically illustrated in FIG. 5, is subsequently generated. The adjustment installation 88 comprises a plurality of adjustment elements 90 which are arranged so as to be mutually parallel and extend in the third direction. The adjustment elements 90 can be formed by wires, for example, and be stationary. The adjustment installation 88 can be a separate device outside the needle loom 2, or be formed by the stitch plate 18 or the down-holding plate 20 of the needle loom 2. If the adjustment installation 88 is a separate device, the adjustment elements 90 are preferably configured so as to correspond to the stitch plate and/or down-holding plate 18, 20 of the needle loom 2, so as to suitably align the needle modules 14. Consequently, it is preferable for the plurality of adjustment elements 90 to define the pitch of the needle modules 14 in the manner desired in the needle loom 2.

The relative movement is at least a stroke of the needle board 10 and of the adjustment installation 88 relative to one another and parallel to the first direction Y, as is illustrated by the arrow B. As a result of the relative movement between the needle board 10 and the adjustment installation 88, the plurality of needles 12 of the plurality of needle modules 14 are aligned on the plurality of adjustment elements 90. When a needle 12 impacts on an adjustment element 90, said needle 12—by virtue of the relative movement—slides along the adjustment element 90, as a result of which the needle module 14 that comprises this needle 12 is displaced in the second direction Z. This can already lead to the correct alignment of the needle modules 14.

However, it is also conceivable for the plurality of needles 12—as a result of the relative movement in the direction of movement B—to initially be arranged between the plurality of adjustment elements 90, to be optionally displaced somewhat in the process, as has just been described, and then to be aligned more precisely at least in the second direction Z by a further movement component of the relative movement. The relative movement in this instance can comprise a component in the first direction Y as well as in the second direction Z. For example, the needle board 10 or the adjustment installation 88 is agitated.

Once the plurality of needle modules 14 have been correctly aligned, the plurality of needle modules 14 in the receiving apparatus 28 are fixed by the fluid-activatable first clamping device 30, as has already been described in detail.

If a bracing apparatus 78 is provided, the latter can be activated after the plurality of needle modules 14 have been fixed. To this end, the bracing elements 80 are moved in the direction of the carrier plate 26, for example by tightening the screw connection 84, such that the receiving elements 50, 52 therebetween receive in a form-fitting manner the plurality of needle modules 14 in the third direction X.

If the adjustment installation 88 is configured as a separate device, the method finally comprises the inserting of the needle board 10 into the needle loom 2. The needle board 10 in the needle loom 2 is then preferably fastened to the needle beam 8 by the second clamping device 34. In order for the entire needle board 10 to be correctly positioned on the needle beam 8, the method, after inserting the needle board 10 into the needle loom 2 and before activating the second clamping device 34, can furthermore comprise the step of moving the needle beam 8 in the penetration direction E so as to by way of a stroke align the needles 12 and thus the needle board 10 on the down-holding plate 20 and/or the stitch plate 18. As a result, the needle board 10 is correctly positioned on the needle beam 8 and can subsequently be fixed on the needle beam 8 by activating the second clamping device 34.

Adjustment screws (not illustrated) can additionally be provided, so as to in the case of segmented needle boards 10, or a plurality of needle boards 10, respectively, on the same needle beam 8 guarantee a mutual alignment, in particular in the direction Z, of the segments of the needle board 10 arranged on the needle beam 8, or of the plurality of needle boards 10 arranged on the needle beam 8, respectively.

The described needle board and method, taking into account the dimensional variances of the components of the needle board, thus enable correct positioning of the multiplicity of needles 12 of a needle beam 8, and thus enable a very high needle density.

A wide variety of materials are available for the various parts discussed and illustrated herein. Although the device has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The invention claimed is:

1. A needle board for fastening to a needle beam of a needle loom configured to consolidate a fibrous pile web, the needle board comprising:

a carrier plate having a receiving apparatus in which a plurality of needle modules are received, wherein the needle modules are arranged in a row, wherein each needle module of the plurality of needle modules has a module carrier and a plurality of needles which are received in the module carrier and fixedly connected thereto; and a fluid-activatable clamping device configured to effect a holding force in a first direction on the plurality of needle modules and/or the receiving apparatus and to fix the plurality of needle modules in the receiving apparatus at least in the first direction;

wherein the needle modules in the receiving apparatus are arranged one behind the other in a row in a second direction which is perpendicular to the first direction.

2. The needle board of claim 1 wherein by the clamping device being configured to effect the holding force at least in the first direction on the plurality of needle modules and/or the receiving apparatus, the plurality of needle modules are fixed in a form-fitting manner in the first direction and in a force-fitting manner at least in the second direction.

3. The needle board of claim 1 wherein the clamping device comprises at least one clamping element which has a first state in which the plurality of needle modules are movable in the receiving apparatus, and a second state in which the at least one clamping element is expanded in comparison to the first state and fixes the plurality of needle modules in the receiving apparatus.

4. The needle board of claim 3 wherein the at least one clamping element is configured as a compressed air hose.

5. The needle board of claim 3 wherein the at least one clamping element is received in the receiving apparatus.

6. The needle board of claim 3 wherein the receiving apparatus is mounted so as to be movable in the first direction relative to the carrier plate, wherein the receiving apparatus by the clamping device is movable between a releasing position and a clamping position, wherein the receiving apparatus is in the releasing position when the at least one clamping element is in the first state, and the receiving apparatus is in the clamping position when the at least one clamping element is in the second state.

7. The needle board of claim 1 wherein the receiving apparatus comprises a first and a second receiving element being mutually opposite and therebetween receiving the clamping device and the plurality of needle modules, wherein the needles of the plurality of needle modules extend out of the receiving apparatus.

8. The needle board of claim 2 wherein the clamping device acts on the receiving apparatus, and the needle board furthermore comprises a fluid-activatable releasing apparatus which, in a direction counter to the holding force, is configured to effect a counterforce on the receiving apparatus so as to release the plurality of needle modules in the receiving apparatus.

9. The needle board of claim 8 wherein the needle board comprises a plurality of layers arranged on top of one another, wherein the carrier plate forms a first layer of the plurality of layers, wherein the releasing apparatus comprises at least one pressure element which is received between two layers of the plurality of layers of the needle board.

10. The needle board of claim 9 wherein the plurality of layers furthermore comprise a further plate which forms a second layer of the plurality of layers, wherein the further plate and the carrier plate are arranged at a mutual spacing and therebetween receive the at least one pressure element.

11. The needle board of claim 9 wherein the releasing apparatus comprises at least one transmission element, wherein the at least one pressure element acts on the receiving apparatus by the at least one transmission element.

12. The needle board of claim 2 wherein the needle board has a bracing apparatus which is configured to effect on the receiving apparatus an interlocking force at least in a third direction which is perpendicular to the first and to the second direction, so as to fix in a form-fitting manner the plurality of needle modules in the third direction in the receiving apparatus.

13. A needle loom for needling a fibrous pile web, comprising:

a needle beam assembly which comprises a needle beam and at least one needle board, which is fastened to the needle beam; and a first main shaft on which a first main con rod is eccentrically mounted, the first main con rod connecting in an articulated manner the first main shaft to the needle beam assembly, wherein the at least one needle board comprises:

a carrier plate having a receiving apparatus in which a plurality of needle modules are received, wherein the needle modules are arranged in a row, wherein each needle module of the plurality of needle modules has a module carrier and a plurality of needles which are received in the module carrier and fixedly connected thereto; and a fluid-activatable clamping device configured to effect a holding force in a first direction on the plurality of needle modules and/or the receiving apparatus and to fix the plurality of needle modules in the receiving apparatus at least in the first direction;

wherein the needle modules in the receiving apparatus are arranged one behind the other in a row in a second direction which is perpendicular to the first direction.

14. The needle loom of claim 13 wherein the needle loom has a further fluid-activatable clamping device which is configured to fasten the at least one needle board to the needle beam.

15. A method for populating a needle board which is configured to be fastened to a needle beam of a needle loom, the method comprising the steps of:

inserting a plurality of needle modules into a receiving apparatus which is attached to a carrier plate of the needle board, wherein needles of the plurality of needle modules extend in a first direction, and the needle modules of the plurality of needle modules in the receiving apparatus are arranged one behind another and movable relative to one another in a second direction which is perpendicular to the first direction;

generating a relative movement between the needle board and an adjustment installation, wherein the adjustment installation comprises a plurality of adjustment elements which are arranged so as to be mutually parallel and extend in a third direction which is perpendicular to the first and to the second direction;

aligning the plurality of needles on the plurality of adjustment elements by way of the relative movement between the needle board and the adjustment installation;

fixing the plurality of needle modules in the receiving apparatus after the alignment, by a fluid-activatable clamping device which effects a holding force at least in the first direction on the plurality of needle modules and/or the receiving apparatus.

16. The method of claim 15 wherein fixing the plurality of needle modules comprises:

fixing in a form-fitting manner the plurality of needle modules in the first direction, and fixing in a force-fitting manner the plurality of needle modules at least in the second direction by the holding force.

* * * * *